US008496524B2

(12) United States Patent
Vancura

(10) Patent No.: US 8,496,524 B2
(45) Date of Patent: Jul. 30, 2013

(54) METHODS OF ENHANCED INTERACTION AND PLAY FOR COMMUNITY-BASED BONUSING ON GAMING MACHINES

(75) Inventor: Olaf Vancura, Las Vegas, NV (US)

(73) Assignee: AGS, LLC, Henderson, NV (US)

( * ) Notice: Subject to any disclaimer, the term of this patent is extended or adjusted under 35 U.S.C. 154(b) by 0 days.

(21) Appl. No.: 13/164,383

(22) Filed: Jun. 20, 2011

(65) Prior Publication Data

US 2011/0312409 A1 Dec. 22, 2011

Related U.S. Application Data

(60) Provisional application No. 61/357,202, filed on Jun. 22, 2010, provisional application No. 61/380,423, filed on Sep. 7, 2010.

(51) Int. Cl.
*A63F 9/24* (2006.01)
*A63F 13/00* (2006.01)

(52) U.S. Cl.
USPC ..... 463/25; 463/16; 463/29

(58) Field of Classification Search
USPC ..... 463/16–20, 23, 25–29
See application file for complete search history.

(56) References Cited

U.S. PATENT DOCUMENTS

| | | | |
|---|---|---|---|
| 426,546 | A | 4/1890 | Reed |
| 524,475 | A | 8/1894 | Wheeland |
| 1,181,027 | A | 4/1916 | Mannhardt |
| 1,520,345 | A | 12/1924 | Hamilton |
| 1,947,772 | A | 2/1934 | Harris |
| 2,192,622 | A | 3/1940 | Radtke |
| 2,614,840 | A | 10/1952 | Monkres |
| 2,732,210 | A | 1/1956 | Heide |
| 3,383,111 | A | 5/1968 | Lucas |
| 3,531,114 | A | 9/1970 | Parks et al. |
| 3,797,828 | A | 3/1974 | Ishikawa et al. |
| 3,807,736 | A | 4/1974 | Goldfarb et al. |
| 3,825,265 | A | 7/1974 | Pitkanen et al. |
| 3,897,951 | A | 8/1975 | Morrison et al. |
| 4,055,342 | A | 10/1977 | Matsumoto |
| 4,055,344 | A | 10/1977 | Soucie |
| 4,508,336 | A | 4/1985 | Yokoi |
| 4,840,375 | A | 6/1989 | Lawlor et al. |
| 4,871,171 | A | 10/1989 | Rivero |
| 5,004,238 | A | 4/1991 | Okada |
| 5,016,879 | A | 5/1991 | Parker et al. |
| 5,120,060 | A | 6/1992 | Parker et al. |
| 5,131,655 | A | 7/1992 | Ugawa |
| 5,149,095 | A | 9/1992 | Kashimoto et al. |

(Continued)

FOREIGN PATENT DOCUMENTS

| | | |
|---|---|---|
| DE | 2 359 603 | 6/1974 |
| DE | 32 20 395 | 12/1983 |

(Continued)

*Primary Examiner* — Milap Shah
(74) *Attorney, Agent, or Firm* — Weide & Miller, Ltd.

(57) ABSTRACT

A plurality of gaming machines is linked, such as via a local bank controller. The gaming machines present base wagering games and, at one or more times, a community bonus event or game involving multiple of the linked gaming machines and their associated players. The community bonus comprises an event or game where awards, information, attributes and/or other features may be exchanged between players, thus fostering interaction/camaraderie between the players. Such features may be exchanged as part of cooperation or competition between players. Player may share in community bonus awards.

26 Claims, 3 Drawing Sheets

U.S. PATENT DOCUMENTS 5,241,379 A 8/1993 Tsujita
5,342,049 A 8/1994 Wichinsky et al.
5,393,057 A 2/1995 Marnell, II
5,462,277 A 10/1995 Takemoto
5,494,287 A 2/1996 Manz
5,509,655 A 4/1996 Ugawa
5,516,104 A 5/1996 Takemoto et al.
5,542,669 A 8/1996 Charron et al.
5,603,659 A 2/1997 Okada
5,628,685 A 5/1997 Takemoto et al.
5,636,837 A 6/1997 Takemoto et al.
5,664,775 A 9/1997 Kao
5,707,285 A 1/1998 Place et al.
5,788,230 A 8/1998 Krise et al.
5,845,902 A 12/1998 Takemoto
5,846,902 A 12/1998 Boyles et al.
5,882,261 A 3/1999 Adams
6,047,963 A 4/2000 Pierce et al.
6,077,162 A * 6/2000 Weiss ..... 463/26
6,139,013 A 10/2000 Pierce et al.
6,146,273 A 11/2000 Olsen
6,203,008 B1 3/2001 Krise et al.
6,203,009 B1 3/2001 Sines et al.
6,217,448 B1 4/2001 Olsen
6,220,593 B1 4/2001 Pierce et al.
6,311,976 B1 11/2001 Yoseloff et al.
6,340,158 B2 1/2002 Pierce et al.
6,358,146 B1 3/2002 Adams
6,390,921 B1 * 5/2002 Busch et al. ..... 463/42
6,398,218 B1 6/2002 Vancura
6,398,219 B1 6/2002 Pierce et al.
6,398,644 B1 6/2002 Perrie et al.
6,419,225 B2 7/2002 Sines et al.
6,419,226 B2 7/2002 Krise et al.
6,443,837 B1 9/2002 Jaffe et al.
6,565,436 B1 5/2003 Baerlocher
6,572,472 B1 6/2003 Glavich
6,582,307 B2 6/2003 Webb
6,595,854 B2 7/2003 Hughs-Baird et al.
6,619,659 B2 9/2003 Krise et al.
6,638,164 B2 10/2003 Randall et al.
6,645,071 B2 11/2003 Perrie et al.
6,645,073 B2 11/2003 Lemay et al.
6,645,074 B2 11/2003 Thomas et al.
6,648,759 B2 11/2003 Vancura
6,685,563 B1 2/2004 Meekins et al.
6,695,699 B2 2/2004 Beaulieu
6,702,670 B2 3/2004 Jasper et al.
6,705,944 B2 3/2004 Luciano
6,726,563 B1 4/2004 Baerlocher et al.
6,743,094 B2 6/2004 Johnson
6,746,327 B2 6/2004 Frohm et al.
6,851,674 B2 2/2005 Pierce et al.
6,896,261 B2 5/2005 Pierce et al.
7,500,915 B2 3/2009 Wolf et al.
7,727,068 B2 * 6/2010 Peterson ..... 463/25
7,753,782 B2 7/2010 Cuddy et al.
7,775,873 B2 * 8/2010 Aoki et al. ..... 463/20
7,789,755 B2 9/2010 Davis et al.
2001/0009316 A1 7/2001 Krise et al.
2001/0009317 A1 7/2001 Krise et al.
2002/0155873 A1 * 10/2002 Berman et al. ..... 463/16
2002/0180145 A1 12/2002 Krise et al.
2002/0180146 A1 12/2002 Sines et al.
2003/0100361 A1 * 5/2003 Sharpless et al. ..... 463/25
2004/0242297 A1 * 12/2004 Walker et al. ..... 463/13
2006/0121971 A1 * 6/2006 Slomiany et al. ..... 463/16
2006/0287043 A1 * 12/2006 Englman et al. ..... 463/16
2007/0060369 A1 * 3/2007 Martin ..... 463/42
2008/0042352 A1 * 2/2008 Darling ..... 273/292
2008/0108429 A1 * 5/2008 Davis et al. ..... 463/26
2008/0176650 A1 7/2008 Wolf et al.
2008/0182664 A1 * 7/2008 Kaplan et al. ..... 463/42
2009/0011824 A1 * 1/2009 Englman et al. ..... 463/25
2009/0275410 A1 * 11/2009 Kisenwether et al. ..... 463/42
2010/0004058 A1 * 1/2010 Acres ..... 463/27
2010/0029363 A1 2/2010 Hoffman et al.
2010/0029367 A1 * 2/2010 Englman et al. ..... 463/20
2010/0035674 A1 * 2/2010 Slomiany et al. ..... 463/9
2011/0230251 A1 9/2011 Nicely et al.
2011/0287824 A1 11/2011 Schultz et al.
2011/0294567 A1 12/2011 Falciglia, Sr.

FOREIGN PATENT DOCUMENTS

EP 0 189 256 7/1986
EP 0 671 713 9/1995
GB 2 218 558 11/1989
JP 3-68382 3/1991
JP 4-73076 3/1992
JP 2002325955 4/2001

* cited by examiner

METHODS OF ENHANCED INTERACTION AND PLAY FOR COMMUNITY-BASED BONUSING ON GAMING MACHINES

RELATED APPLICATION DATA

This application claims priority to U.S. Provisional Patent Application Ser. No. 61/357,202, filed Jun. 22, 2010, and U.S. Provisional Patent Application Ser. No. 61/380,423, filed Sep. 7, 2010.

FIELD OF THE INVENTION

The present invention relates to casino games and methods of play in casino gaming machines and, in particular, to casino gaming machines that have community bonus play features.

BACKGROUND OF THE INVENTION

Casino gaming machines such as a slot machine are a staple of the casino industry. Slot machines having an underlying casino base game with an accompanying bonus game are also well known. In particular, a bonus game manifested as a "game within a game" is popular. Likewise, placing the bonus game in a top box physically above the base game, especially to attract attention and to make players feel special, are well known.

Typically, bonus games are triggered, or activated, based on the random play of the underlying base game. Once triggered, a bonus condition is issued. Dedicated base game symbols known as "triggers" are also often used, although the bonus game may be triggered by other random events.

An in-machine bonus game is one in which the player completes the bonus in a traditional, solitary manner. Community bonus games, or bonus games in which 2 or more players may simultaneously participate, have become a popular form of gaming.

Community bonus games may be triggered randomly (wherein, e.g., each linked machine has a 1 in 500 chance on each spin either through a separate random process or via base game triggers), via a mystery progressive (wherein coin-in, or a fraction or multiple thereof, is accumulated and utilized to trigger the community bonus once a mystery trigger point is met), or every set number of games (wherein players need to qualify by accumulating, for example, triggers prior to the community bonus initiating). The various methods of initiating a community bonus afford either qualifying players or in some cases, all players (e.g., by utilizing timers to determine who is "actively" playing) participation in the bonus game.

The community bonus game itself historically has incorporated competition of some kind, and each bettor chooses a character that competes, e.g. in a space race (e.g., IGT's Star Wars MLP™) or fishing competition (WMS Gaming's Reel 'em In! Compete to Win!™), to determine individual order of finish, hence awards for bettors. In at least one case (WMS Gaming's Monopoly Big Win™), all players are associated with the same token character and share an identical fate. In all cases, the characters are merely icons denoting the individual players during the bonus play.

The community bonus game typically takes place on a common screen (or screens) or apparatus (e.g., IGT's Wheel of Fortune Big Spin™) adjacent to or above the linked slot machines that are eligible to participate in the community bonus. In this fashion, once the community bonus begins, all players participating in the bonus (whether a subset or all active players) stop betting and instead focus upon a common display. The community bonus typically takes approximately 1 minute to complete, players return to betting at their individual slot machines.

Other attempts at providing bonusing to linked games include a method whereby active players must continue to wager during the bonus time period. One such example provides a mystery pool funded by wagers at linked machines, which once triggered, initiates a special mode wherein the pool is dispensed in the form of random but fixed awards (e.g., 5 credits, 25 credits, etc.) credited to individual eligible players of slot machines who continue to bet actively during the special mode (e.g., Progressive Gaming's Money Time™, see U.S. Pat. No. 6,146,273). In another example, during the special mode eligible machines are chosen randomly for a short time such that a win during that time is multiplied (e.g., Progressive Gaming's Hot Potato™, see U.S. Pat. No. 6,217,448), and the excess award (above 1×) is deducted from the pool. In both of these examples, once the mystery pool drops to a predetermined level, the special mode is discontinued and begins funding anew.

In another example of a community bonus game, players provide input on individual, eligible slot machine displays toward the goal of completing a puzzle (choosing letters, as depicted both on the individual and/or adjacent common screen, in IGT's Wheel of Fortune Triple Spin Center Stage™ game) or reaching a destination first (through mileage accumulated during free spins and/or choosing objects in IGT's Amazing Race™ game).

A continuing need exists in the casino gaming industry to provide new and exciting games to the playing public. A need exists in the casino gaming industry to create methods of playing community bonus games, as often players are motivated to play slot machines to get into the bonus games themselves. A particular need exists to enhance bonus play wherein players actively participate and do not merely passively observe. In particular, it would be desirable to have players, to enhance camaraderie, interact with each other, exchanging information and/or game-related attributes. It is desirable, as an element of the game play, to have players cooperate toward achieving a common goal, combining the cooperation with a competitive element, instead of only incorporating game play in which players only compete against one-another or, conversely, are treated as one and so all root for the exact same outcome. It would also be desirable to have players be able to individualize and/or customize their characters' attributes and/or abilities. It would be desirable to implement community games which utilize mechanical apparatuses, especially those which utilize free motion such as found in a pachinko top box, in conjunction with these aforementioned goals.

A desire also exists to implement new casino games and new methods for players to enjoy at existing gaming machines and systems, thus also offering economies to casinos.

SUMMARY OF THE INVENTION

One or more embodiments of the invention comprise gaming machines, gaming systems and methods of presenting and playing games. A preferred embodiment of the invention comprises community bonus type games where awards, information, attributes and/or other features may be exchanged between players.

In one embodiment, one or more community games are implemented at a plurality of linked gaming machines. Each gaming machine is preferably configured to present one or more base games. The base games may comprise wagering or casino-style games such as mechanical or video slot games. Base game information may be displayed on a main display or via main spinning reels of the machine.

Community game information may be displayed by one or more secondary displays or devices. For example, each gaming machine may include a top box which includes one or more video displays for displaying bonus game information. In another embodiment, each gaming machine may include a top box which includes one or more mechanical game devices and/or video game devices, such as a pachinko-style top box with or without a video display.

At one or more times, a bonus event may be triggered. Such may be triggered by a base game result at one of the gaming machines, randomly or based upon other factors. While the trigger may trigger a local or "in machine" bonus game, preferably at one or more times a bonus event which is applicable to multiple gaming machines, i.e. a "community" bonus event, is triggered.

In one embodiment, triggering of the bonus game or event and various aspects of presentation of the bonus game or event may be controlled by a remote controller (one that is separate from each gaming machine's controller). Such a controller might comprise a local bank controller.

In one embodiment, because the gaming machines are liked, information may be exchanged between them, such as via the local controller. Under this paradigm, players at the gaming machines may, by choice or automatically, specifically or randomly, exchange awards, information, attributes and/or features with each other, preferably as such relate to the community bonus event.

In one embodiment, players may cooperate in attempting to achieve a common goal within the community bonus, and/or may compete against each other. Additionally, teams of players may be formed in order to increase excitement and camaraderie, and the benefits thereof. In total, the teachings herein foster a social atmosphere and goodwill amongst the players.

Those skilled in this art will appreciate that various changes, modifications, use of other materials, other structural arrangements, and other embodiments could be practiced under the teachings of the invention without departing from the scope of this invention as set forth in the claims.

DETAILED DESCRIPTION OF THE INVENTION

Figure 1:
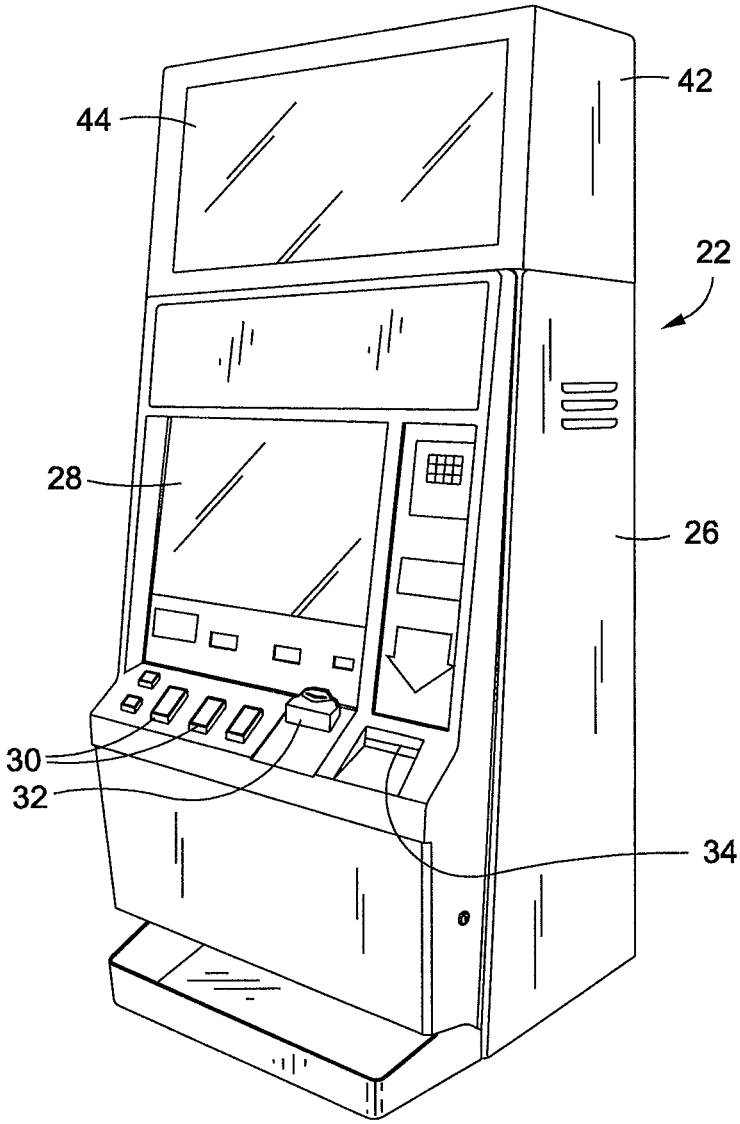
FIG. 1 illustrates a gaming machine in accordance with the present invention, the gaming machine including a top box with a video bonus display.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention comprises configurations of gaming machines, gaming systems, and methods of game play, including community bonus type games having a feature where awards, information, attributes and/or other features may be exchanged between players and/or gaming machines.

Gaming Machines And Systems

One aspect of the invention is a gaming machine which is configured to present a game, and most preferably a community game such as a community bonus event.

The many conventional details for operating a casino-style or wagering gaming machine are well understood in the industry, including receiving money, accepting wagers, delivering payoffs, presenting games and the like. In particular, a conventional money reception device(s) such as a bill acceptor, ticket acceptor, or coin slot may be utilized. In addition, such conventional wager device(s) such as push-buttons or a touch-screen may be utilized to initiate play. Typically, players may have special player inputs (either physical and/or on-touch-screen) that denote a max bet, spin of the reels, a bonus bet, etc. Likewise a conventional payout device(s) such as a ticket dispenser, bill dispenser, coin dispenser, etc. or any suitable payout device or devices are possible. As detailed below, the gaming machines may communicate over a network card or other communication interface and communication links, with one another, other devices such as controllers, servers or the like. The gaming machines may be linked via controller to form a linked system of gaming machines.

A computer may be functionally interconnected to the money reception device(s), interconnected to the wager device(s), interconnected to the player wager input device(s), interconnected to payout device(s), interconnected to a memory or memories, and interconnected to the top-box bonus game by way of a communications port. The computer may control the base games and the top box bonus game in the casino gaming machines. In another embodiment, the computer communicates with a top-box controller which controls the top box bonus game.

The computer can be any type of one or more processors, microprocessors, controllers, gaming platforms, etc. suitably adapted for the casino game machine as conventionally done in the gaming industry. The computer is also connected to a touch-screen and/or a second screen. The various methods of base game and bonus game play described herein are conventionally programmed into memory so that the computer can implement the teachings contained herein.

Conventionally, the general functional configuration of the gaming device preferably includes a computer memory device(s) for storing program code or other data, main display device, optional secondary display device(s), sound card, speaker(s) and one or more player input devices such as a touch-screen. The computer functionally displays images, symbols and other indicia such as the faces and backs of cards and/or a wide variety of gaming symbols either itself or through communication with a graphics card or a graphics controller. The memory device can include random access memory (RAM) for saving or accessing game data generated or used during a game. The memory device can also include read only memory (ROM) for storing program code which controls the casino gaming machine so that a particular game (s), such as the game(s) of the invention, is loaded and plays in accordance with appropriate game rules and pay tables. Although the computer and memory device preferably reside on each casino game machine, it is also possible to provide at least some of their central location such as a network server for communication to a playing station such as over a network local area network (LAN), wide area network (WAN), Internet connection or other wireless link such as through a network card. With regard to generating random events from a random number generator (e.g., the dealing of cards), it is possible for this to occur locally (e.g., at or within the gaming device or local-area controller) or non-locally (e.g., centrally at a server accessed by wire or wirelessly) or a combination thereof. The random number generator can be a separate component or implemented in software in memory. At least some or all of the above are functionally found in hardware, firmware, and software of conventionally available gaming platforms.

The conventional casino base machine also includes a base game platform, which may be video or mechanical (stepper). For purposes of the present invention, in one embodiment, the casino base game is a multi-reel, multi-line video presentation on a conventional touch-screen. Many conventional products of such multi-reel, multi-line casino games are known.

For example, FIG. 1 illustrates one embodiment of a gaming machine 20 configured to present games of the invention. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type or other configuration as is well known to those of skill in the art).

The gaming machine 22 preferably includes at least one display device 28 configured to display game information. The display device 28 may be a mechanical, electro-mechanical or electronic display, such as one or more rotating reels, a video display or the like. When the display device 28 is an electronic video display, it may comprise a cathode ray tube (CRT), high resolution flat panel liquid crystal display (LCD), projection LCD, plasma display, field emission display, digital micro-mirror display (DMD), digital light processing display (DLP), LCD touchscreen, a light emitting display (LED) or other suitable displays now known or later developed, in a variety of resolutions, sizes and formats (e.g. 4:3, widescreen or the like). The display 28 may be capable of projecting or displaying a wide variety of information, including images, symbols and other indicia or information associated with game play, game promotion or other events.

As described in more detail below, the gaming machine 22 is preferably configured to present one or more games upon a player making a monetary payment or wager. In this regard, as described in more detail below, the gaming machine 22 includes means for accepting monetary value.

In one embodiment, certain game outcomes may be designated as winning outcomes. Prizes or awards may be provided for winning outcomes, such as monetary payments (or representations thereof, such as prize of credits), or promotional awards as detailed herein. As detailed below, the gaming machine 22 includes means for returning unused monetary funds and/or dispensing winnings to a player.

As indicated above, the gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game (such as spin slot reels or display cards in a video poker game), to indicate cards to be held or discarded in a game of video draw poker, to "cash out" of the gaming machine, or to provide various other inputs.

In one preferred embodiment, the gaming machine 22 includes at least one microprocessor or controller for controlling the gaming machine, including receiving player input and sending output signals for controlling the various components of the machine 22 (such as generating game information for display by the display 28). The controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the at least one display 28 (such as information representing images of displayed cards, as disclosed below), for determining winning or losing game outcomes and for displaying information regarding awards for winning game outcomes, among other things.

The controller may be configured to execute machine readable code or "software" or otherwise process information, such as obtained from a remote server. Software or other instructions may be stored on a memory or data storage device. This software may be configured to implement the game described below, such as in the form of one or more steps. The memory may also store other information, such as pay table information, card images or the like. The gaming machine 22 may also include one or more random number generators for generating random numbers, such as for use in selecting, cards or the like for presenting the game in a random fashion.

The gaming machine 22 may be configured to generate and present games in a stand-alone manner or it may be in communication with one or more external devices at one or more times. For example, the gaming machine 22 may be configured as a server based device and obtain game code or game outcome information from a remote game server (in which event the gaming machine controller may receive game information from the server, such as game outcome information, and use that server-generated information to present the game at the gaming machine). In one embodiment, the gaming machines 22 may be game kiosks or interfaces.

As indicated, the gaming machine 22 is configured to present one or more wagering game. Thus, the gaming machines 22 is preferably configured to accept value, such as coins, paper currency or other elements or devices representing value such as monetary funds. For example, as illustrated in FIG. 1, the gaming machine 22 might include a coin acceptor 32 for accepting coins. Of course, associated coin reading/verifying devices and coin storage devices may be associated with the gaming machine 22 if it is configured to accept coins. Likewise, the gaming machine 22 might include a media reader 34. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 22, such as by dispensing coins to a coin tray. In another embodiment, funds may be issued by dispensing paper currency. In yet another embodiment, a player may be issued a media, such as a printed ticket, which ticket represents the value which was paid or cashed out of the machine.

Figure 3:
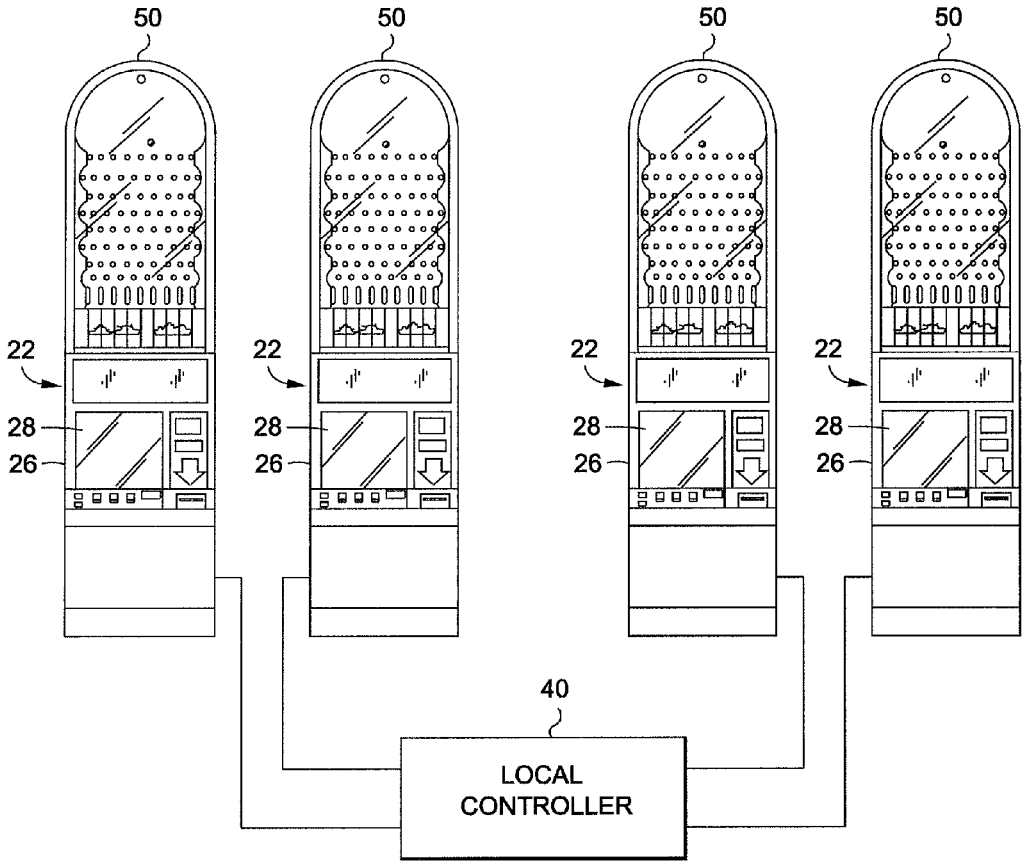
FIG. 3 illustrates a gaming system including a plurality of gaming machine and a local controller.

As illustrated in FIG. 3, various gaming machines 20 may be linked to one another and either communicate with one another or one or more external devices. The two or more gaming machines 22 may be remotely located or might be arranged into one or more groups or "banks" of closely located gaming machines.

For example, as illustrated in FIG. 3, a local-area controller (denoted herein as a local controller) 40 is linked to each of several gaming machines 22. Logically, the local controller communicates with each machine on the link, such as through a gaming machine interface board or similar technology, as is well known in the field. In a preferred embodiment, each individual machine has logic (either through the base game CPU or a top-box controller, collectively denoted herein as a machine computer) which keeps track of the individual machine's status within the community bonus round. For example, for a bank of 8 machines, one local controller communicates with 8 machine computers. In another embodiment, a communications bus connects the 8 individual machines to each other, and the machine computers communicate directly with each other without the need for a central local controller to carry out the teachings herein.

In one embodiment of the invention, as illustrated in FIG. 1, a gaming machine 22 may include a top box 42 having at least one video display 44 for displaying a video representation of the top box bonus game. In the configuration illustrated, the top box 42 comprises a housing which supports at least one electronic video display 44. Of course, the top box may have various configurations. In one embodiment, the top box may simply be a top portion of the housing 26 of the gaming machine. In another embodiment, the video representation can be incorporated into a second-screen of the same base screen 28, so as to eliminate the additional structure and cost associated with a top box. In addition, multiple bonus games either on the base game or within the top box can be utilized under the teachings of the invention, without the need for additional hardware. Preferably, the casino base game communicates with a top box controller (not shown) during game play, in order to send instructions and data to the top box, receive results and data back from the top box, and so forth as is conventional in the gaming industry.

Figure 2:
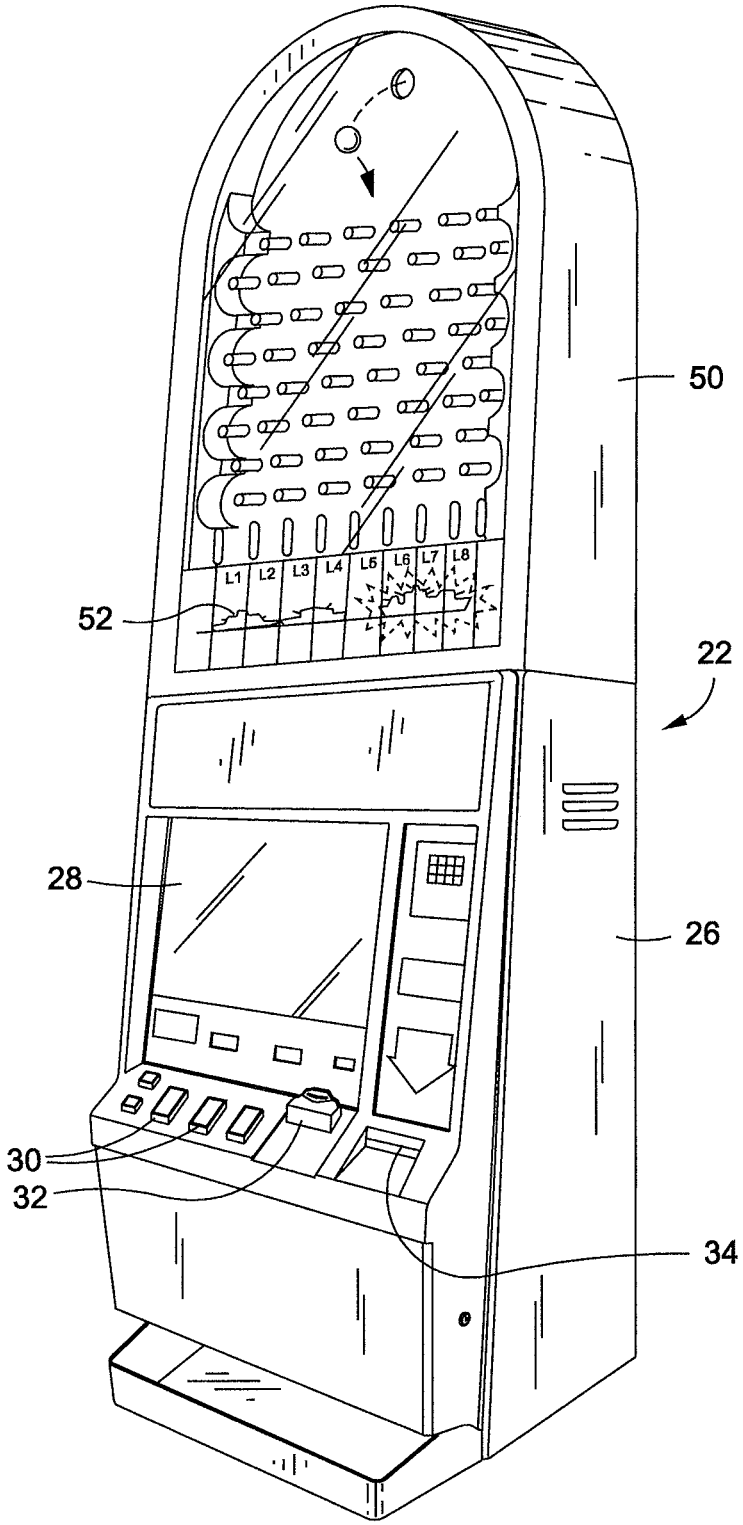
FIG. 2 illustrates a gaming machine in accordance with the present invention, the gaming machine including a pachinko-style top box.

In another embodiment, as illustrated in FIG. 2, the gaming machine 22 may include a top box 50 which houses a bonus game of a mechanical free-motion type. The mechanical pachinko top box has a playfield of deflecting pins and free motion balls that are delivered to the top of the playfield, bounce and ultimately fall through one of ten lanes, is utilized for play of the bonus games. On a display either behind, immediately below the lanes or otherwise associated with the lanes, the lane values and/or lane symbols are displayed. See U.S. Pat. No. 6,896,261 and U.S. Pat. No. 6,851,674 for Pachinko casino games having these features. As detailed below, this top box 50 may also include one or more video displays, such as used in conjunction with or forming a part of the mechanical top box feature. For example, such one or more video displays may display bonus game information such as ships or other targets for the free motion balls.

It is also noted that while bonus games of the invention may be presented at each gaming machine, such as by top boxes of each gaming machine, the bonus games or events might be presented via one or more common displays devices. Such might comprise one or more bank or community video displays. Such displays might be located above two or more gaming machines.

Finally, it is understood that the casino games and methods of the invention herein can be implemented in consumer computer systems such as Apple MAC computers, PCs and/or over the Internet or other networks (whether wired or wireless).

Aspects of games and methods of game play will now be described. In one embodiment, a gaming machine is configured to present a base game and, in one or more instances, a bonus game.

Casino Base Game

A gaming machine 22 of the invention may be configured to present a variety of base games. In one embodiment, for example, the base game might comprise a video slot game.

In one embodiment, as indicated above, the gaming machine 22 may be configured as a video gaming machine, such as to present a video slot game via a touch-screen display. The gaming machine 22 may be configured to display a traditional 5×3 matrix of symbols (5 reels×3 symbols appearing on each line within a "window"). As is well known in the art, in such a configuration, the symbols which are displayed in the matrix may be evaluated along one or more pay lines for winning combinations. For example, the 15 symbols may be evaluated along 30 pay lines. The player may wager in increments of 1-coin per line to activate 1 to 30 pay lines. In addition, the player may be permitted to place a "buy-a-pay" wager. Buy-a-pay is an arrangement whereby a subset of payoffs must be "bought" in order to be active. Historically used on mechanical slots, for example, a first coin would buy a set of "cherry" pays, the second a set of "bar" pays, and the third a set of "7" pays. For example, a player playing one coin and hitting 7-7-7 would not get paid on such a machine. The "buy-a-pay" formats are used on video slots now as well, in order to offer access to payoffs, features or bonus games that otherwise would not take place.

On the touch-screen, on the bottom of the screen starting on the left and going across are the following touch buttons and/or boxes: Help/Pays button, Denomination icon (going to a denomination selection screen if touched), Credit Box, Lines Box, Line Bet Box, Bonus Bet Box and Win (Paid) Box. Except for the Credit and Win Boxes, these all comprise player inputs shown in FIG. 1 from the touch-screen when touched by the player.

The "Bonus Bet" feature is typically activated by a fraction (e.g., ½) of the total 30-line bet if wagering upon all 30 lines. In principle, the Bonus Bet need not be utilized under the teachings herein, or might be utilized in a different manner. In a preferred embodiment, the Bonus Bet affords the player the opportunity for additional bonuses or feature play on the gaming machine.

The base gaming machine game includes different types of play symbols and typically includes a wild symbol, different themed symbols and one or more trigger symbols. Any theme or set of names could be used for the symbols including trigger and wild symbols.

Of course, the base game could comprise any variety of games. Preferably the base game is a wagering or "casino-style" game (wherein a player is required to place a wager in order to play). The base game might comprise, for example, a mechanical-reel slot game or other games such as video poker, blackjack or various other games now known or later developed.

Initiation of Community Bonus Games

As indicated above, in one or more embodiments of the invention, a method of game play includes a bonus game. In a preferred embodiment, the bonus game is a community type game.

In one embodiment of the invention, such a community bonus game is initiated or started at one or more times, such as based upon one or more criteria.

In one embodiment of the invention, a "set" of base game triggers may be utilized. A bonus game may be initiated when a predetermined number of trigger symbols are located along one or more active pay lines on any individual gaming machine. In a most preferred embodiment, the player directly (preferably via touching directly on the base touch-screen) selects one or more of the actual trigger symbols, which either launches a community bonus game or reveals an attribute.

For example, once three or more trigger symbols appear, the player may then be prompted to pick one trigger by touching the symbol directly on the touch-screen. Thereafter, the picked trigger animates to reveal either a start community bonus outcome or an attribute and/or bonus award. In principle, other animations or methods of revealing whether or not the trigger qualifies the player for the community bonus game are possible. In the preferred embodiment, the attributes (play next in-machine bonus at 2×, enhance character for next community bonus, hint for next trivia question, etc.) and/or bonus awards (start in-machine bonus, numerical bonus award, numeric values such as $3 or 300× line bet, prizes, etc.) are randomly assigned to the trigger symbols. The term "attribute" may be an object, quality or rule modification that mathematically has value to the player, and thereby having the attribute affects the expected value for the player as compared to not having the attribute, such objects, qualities or rule modifications denoting: bonus game enhancement (such as giving the player extra picks, chances or spins, character enhancement as described below, an increased multiplier, etc.), base game enhancement (such as giving the player free spins, multiplying the next win 3×, increasing the number of wilds for the next spin, making all red symbols pay 2× for the next 5 spins, adding extra pay lines without an additional wager, etc.), etc.

In one embodiment, when a bonus game is triggered, it may be applied to all gaming machines/players, or only certain gaming machines/players. For example, a bonus game triggered at one gaming machine may only be activated at other gaming machines where players have qualified, such as by using their player tracking/club card, by engaging in a requisite level of game play or the like.

Community Bonus Game

Set forth below are several examples of community bonus games reflective of the aspects of the instant invention.

EXAMPLE 1

Incorporating a Mechanical Pachinko Bonus Game

As an embodiment of the instant invention, as illustrated in FIG. 3, a set of gaming machines 22 utilizing mechanical pachinko top boxes 50 presenting a bonus game are linked to one another. The gaming machines may be configured to present a bonus game in which players attempt to sink one or more ships 52 depicted within one or more lanes (see, e.g., U.S. Pat. No. 6,851,674 which is incorporated herein in its entirely by reference). In accordance with the teachings herein, the players may collectively try to sink the ship(s). For example, the pachinko display areas of the various machines may be linked and under the direction of a local controller, such that the image of a pirate ship travels from one display to the next while players are launching pachinko balls to try to sink the ship.

Each gaming machine 22 on the link is equipped with a mechanical pachinko top box 50. Upon triggering with 3 or more trigger symbols on an individual gaming machine (or other triggering event, as detailed above); the player enters a second-screen display wherein 5 scrolls are depicted. Each of the scrolls hides either a numeric award or entry to a bonus game. In a preferred embodiment, at least one of the scrolls initiates an in-machine bonus that the player completes the bonus in a traditional, solitary manner. Also preferably, one of the scrolls hides a Jolly Roger flag which initiates a community bonus in which all active machines qualify to play.

If initiating the community bonus, then cannon blasts are heard, and all gaming machines on the link, via a multimedia presentation including on-screen messaging and audio, announce that a pirate attack is imminent. All active machines are then placed "on alert" that the community bonus is imminent, and once each machine is ready (that is, the individual game in progress is over), the community bonus initiates.

In a preferred embodiment, one or more pirate ships 52 are depicted across a plurality of lanes on the top box 50 of at least one gaming machine. The original depiction of the pirate ship(s) is preferably random. Also preferably, the lanes not occupied by a pirate ship display numeric credit awards which are a function of the individual machine's wagering. In one embodiment, credit awards are also depicted (either behind, under or over) in the lane(s) occupied by a pirate ship. The bonus is comprised of players, via touch-screen on the individual machines, prompting ball drops to win either numeric credit awards or sink the pirate ships. If a pirate ship is sunk (that is, the ball lands in a lane across which the pirate ship is depicted), the player preferably wins all numeric values showing on his/her individual machine, and also to foster camaraderie an award is also given to all players on machines participating in the community bonus round.

In a preferred embodiment, the numeric credit awards displayed for the individual lanes are randomly modified in a staggered, random manner such that a random lane is updated with period every 0.2 seconds (on average all 10 lanes are updated every 2 seconds). However, to increase suspense, once a ball is dropped, then 4 seconds after the ball is released, the lanes no longer update but are rather "locked-in" so that the player may properly anticipate and root for the lanes with the highest awards. Once the ball is recaptured (approximately 6 seconds after being dropped) in one of the lanes, then either immediately or after affirmation of the award won, again the random lane updating resumes.

In a preferred embodiment, the pirate ship is capable of moving across the lanes in the display, and as it does so, the unoccupied lanes (and in one embodiment, also the lanes occupied) display numeric credit awards with the same 0.2 second period. As with the numeric lane values, the pirate ship stops moving 4 seconds after a ball is released, so as to have its position "locked-in". Once the ball is recaptured, the pirate ship resumes movement.

In a most preferred embodiment, the pirate ship also moves between displays on adjacent machines. So, for example, at a moment in time (say, t=0 seconds) the pirate ship may be displayed across lanes 2, 3 4 on gaming machine 3. It moves while awaiting a ball drop. At t=0.6 seconds, when a ball is dropped at gaming machine 1, the pirate ship may be displayed across lanes 4, 5, 6. It may continue to move, and the lane values oscillate, until time t=3.6 seconds, when the ship stops across lanes 3, 4, 5 and the lanes also lock-in. Once the ball has landed in a lane, then the pirate ship resumes movement. It may stay on gaming machine 3 or preferably (since machine 3 has already had a shot at it) move onto neighboring gaming machine 2 or 4, in order to allow the player on that machine to have a shot at sinking it. Preferably, once a player has had a shot at the pirate ship, then the player waits a predetermined period of "downtime" (such as 5 seconds), while the associated award is celebrated and credited to a bonus win meter, before being able to drop another ball. The downtime is preferably occupied partially by a celebration and partially by the credit up; in this way major awards (incorporating a bigger celebration and/or longer credit-up) may naturally lead to longer downtimes. It is during this downtime that the controller moves the pirate ship onto a neighboring gaming machine. In one embodiment, the downtime is eliminated or minimized so that player may drop balls as rapidly as possible.

The community bonus round may last a prescribed amount of time (e.g., 100 seconds). During this time, players may drop balls as quickly as possible, with possible constraints such as waiting a set time between drops or waiting to drop a second ball until all players have dropped a first, etc. Alternately, the round may last a prescribed number of ball drops (e.g., 3× the number of qualifying machines) such that each qualifying machine, on average, gets 3 ball drops. It may also last a prescribed number of ball drops (e.g., 3) on each qualifying machine such that each player gets exactly 3 ball drops. In one embodiment, the community bonus round lasts until all ships are sunk. In one embodiment, the round lasts at least until every player has had a chance to "shoot" (via ball drop) at the ship. In one embodiment, each award decrements a mystery meter, and the round lasts until the meter decrements to a predetermined value.

In a most preferred embodiment, the lane values on a particular machine are based on the last wager made prior to qualification on the machine (referred to herein as the last wager made). In this fashion, a player wagering 5 credits per line will have numeric lane values 5× that of a player wagering 1 credit per line. A fleet of ships, equal in number to the number of qualifying gaming machines, is utilized. A bonus round of approximately 90 seconds is utilized, pachinko top boxes are utilized in which the average ball drop takes between 6 and 8 seconds, and a player may not drop a ball until at least 4 seconds have elapsed since the last ball drop ended. If a particular player sinks a ship, then the particular player is awarded the sum of all lane values currently depicted on his/her machine, and in addition each player participating in the community bonus wins a "sunken ship" community award based on the last wager made at each respective machine. A "sunken fleet" award, based on the last wager made and given to all players if the entire fleet is sunk, may also be utilized.

In another embodiment, the top box displays 50 do not depict the numeric values but only the ships 52. The base screen of each qualifying machine depicts a set of objects which hide numeric values. For example, a set of 30 treasure chests may be utilized. A player dropping a ball and missing a ship is directed to choose an object on the base screen and wins the associated award. A player sinking a ship may win all the treasure chest awards, or may be directed to choose, e.g., 5 chests and wins the 5 associated awards.

Specifically, the each gaming machine computer or controller monitors and transmits the following information to the local controller: Ball drop status (ball currently being dropped, ball not currently being dropped); If currently in a ball drop, then time since ball was dropped; If not currently in a ball drop, then time since last ball drop ended (that is, time since last ball was recovered in the lanes), outcome of last ball drop (ship sunk, ship not sunk) and player drop eligibility (ball may be dropped, ball may not be dropped).

This information is delivered to the local controller, either as the local controller polls the information from the individual machines, or alternatively is communicated to the local controller upon any state change at the individual machine (e.g., player drop eligibility goes from "may not" to "may" be dropped).

The local controller 40 receives this input from each gaming machine 22 and in conjunction with the "lock-in time" parameter, communicates to each individual gaming machine what the individual top box display should do with respect to the ships until the next state change. As discussed earlier, the "lock-in time" parameter represents the time, since the initiation of a ball drop, within which the ship(s) may move, and after which the ship(s) need to be stationary. The precise lock-in time may be configurable at the game or local controller level, or may be hardcoded. It is preferably 4-5 seconds.

For example, assume that there is only one ship that the local controller currently has positioned on gaming machine 2. In a mode where the ball is not currently being dropped, the local controller sends a signal to gaming machine 2 to "randomly move" the ship on the playfield. The "randomly move" command is executed at the gaming machine controller or computer, whereby the ship randomly moves to and fro, sometimes pausing and sometimes accelerating, etc. The location of the ship is kept at the machine level, and need not be transmitted to the local controller, which simply "knows" that the ship is located at machine 2 and no ball is currently being dropped on gaming machine 2.

At such time as gaming machine 2 sends a signal to the local controller that a ball is now being dropped, the local controller sends a return signal telling the machine computer what to do with the ship. This signal may tell the gaming machine to move the ship to a prescribed set of lanes, move the ship off-screen (exit to the right, or exit to the left), or simply allow the gaming machine to continue to randomly move the ship within the lock-in time. Alternatively, the local controller may tell the gaming machine what to do with the ship but not transmit the lock-in time; in this case the gaming machine controller or computer would know the lock-in time, and that the ship needs to have completed its movement within the lock-in time. In another alternative, the local controller signals to the gaming machine only if the ship is to (1) stay on the machine, (2) exit left or (3) exit right. And if the ship is to stay on the gaming machine, the machine computer understands that random movement is to continue until the lock-in time, at which point the ship stops across one or more lanes until the ball drop has ended.

If the ship exits right from gaming machine 2, then the local controller next transmits information to gaming machine 3 to have the ship enter from the left. This completes the illusion that the ship has moved from gaming machine 2 to gaming machine 3. Preferably, the ship enters the gaming machine 3 display during a time when the gaming machine is in a mode wherein a ball is not currently being dropped or is currently being dropped but within the lock-in time window (and possibly within a smaller time window within the lock-in time, such that sufficient time exists to move the ship to a random stopping location). If not in this mode, then the gaming machine waits until a ball is not currently being dropped, and then displays the ship entering from the left.

After the conclusion of each ball drop, the gaming machine controller or computer transmits the state change to the local controller, in addition to status as to whether or not a ship was sunk. If a ship was sunk, the local controller removes this ship from future display, and keeps a record of its sinking (for a community award to all players based upon total ships sunk, e.g.). If the ship was not sunk, then during the downtime, the local controller may again instruct the machine computer what to do with the ship (e.g., move randomly, exit left, exit right).

It is noted that the above-described logic structure need not be accomplished in the exact manner described. More, or less, control may be given to each individual gaming machine versus the local controller. It is preferred, for game recall purposes, that a time stamp be associated with each ball drop initiation and end, and outcome, at each individual machine.

EXAMPLE 2

Incorporating a Mechanical Pachinko Bonus Game

As above, each gaming machine 22 is preferably equipped with a pachinko-style top box 50. Preferably, a local controller 40 communicates with the individual machines, such as the computers or controllers thereof.

Competition Embodiment

In this embodiment a race takes place based upon a carnival-style event in which camels (or other animals or objects) race to the finish line, the winner determined as players roll balls up a slight incline, dropping into numbered holes representing camel movement toward the finish line.

In the adaptation of the instant invention, once the community bonus round initiates, players drop balls into lanes depicting movement values. The movement values correspond to incremental movement of the racers toward the finish line. The movement values may be depicted as numeric values or symbolic values. For example, if rabbits are racing the lanes may depict one, two or three carrots, such that the ball landing into a lane with three carrots will move the rabbit three times as far as a ball landing into a lane with one carrot. Similarly, one to five arrows, or horseshoes, etc. may be used to depict movement.

Each player is hoping to get high movement values to maximize his/her chance of winning the race. As with the first example of sinking ships, downtime may be utilized, for example to equilibrate the racers, making the race closer and more exciting. This may be accomplished by making the downtime upon scoring a high movement greater than that upon scoring a low movement.

In one embodiment, the lanes comprise numeric awards and movement values. In an alternate embodiment, if players miss a lane with a movement value, they select an on-screen object to reveal a numeric award prior to the next ball drop.

Cooperation Embodiment

In this embodiment, for example, a community bonus has players, as characters, fighting a common enemy such as a dragon. The lanes may define attack values, with each player hoping to get high values so that maximum damage may be inflicted on the dragon. The dragon, too, may randomly breathe fire and destroy the players' characters. The game is won if the players succeed in destroying the dragon before the dragon succeeds in destroying one or all of the players' characters.

In one embodiment, each participant (players' characters and the dragon character) has a "health meter" depicting how much life is left before the character is destroyed. In this way, suspense may be heightened during the course of game play.

EXAMPLE 3

Exchange of Awards

Consider an example wherein several players Alex, Barbara, Charlie, Darlene, Eric, Flo at gaming machines MA, MB, MC, MD, ME, MF are playing simultaneously. In a first method of enhancing camaraderie, when Alex wins an award designated as extra, then Alex wins the award and, say, Darlene wins an extra award. Alex's award is preferably a pay table award, and the extra award may be a fixed amount based on the pay table or may be random. The extra award may always occur, based on certain pays that are designated as having the extra award component, or may occur randomly. The term "extra" as used herein doesn't necessarily mean that a portion of one player's award is taken away and given to another and doesn't necessarily mean that a portion of one player's award is not taken away and given to another; it simply refers to the teaching that an outcome on an individual machine yields a plurality of awards given to more than one player.

The extra award can be randomly given to 1 or more of the other players who are playing, may be designated for a particular machine, e.g. MD, or may be selected or preselected by Alex. The award may be designated to be multiplied by line bet or total bet, and may be a function of a bonus bet that buys access to these extra awards. E.g., if Alex is betting 30 lines× 10 credits/line+100 credits feature bet, and Barbara is betting 30 lines×1 credit/line with no feature bet, then in one embodiment, Barbara would not be eligible to obtain an extra award. In another embodiment, Barbara would be eligible. Alternatively, Alex's wins may directly transfer to Charlie (based on Alex's wagering level) or may transfer to Charlie (based on Charlie's wagering level).

In one embodiment, the local controller receives messaging relating to each machine's outcome and determines if extra awards occur, and to which machine they will be given. In a preferred embodiment, this determination of an extra award is done at the machine level, the amount is determined at either the machine or local controller, and the extra award destination is determined by the local controller which keeps track of which gaming machines are active. So, for example, the local controller may receive a message from gaming machine #1 to give 25 credits as an extra award, and the local controller may randomly decide to give the award to gaming machine #3. The local controller, acting as the hub of information flow, then directs gaming machine #3 to pay the amount of the extra award.

In a preferred embodiment, players input their first names, or nicknames, through prompting via an on-screen interface. This information, by machine number, is transmitted to the local controller. For players who do not wish to give a name, the machine number is utilized in messaging.

To emphasize what is happening, preferably communication is enabled between machines through the local controller. So for example, if Alex wins an award for 500 credits with an extra award of 50 credits, and randomly the local controller determines that Charlie will win the extra 50 credits, then the following sequence takes place from the player's perspective. At the conclusion of Charlie's current game, on Charlie's machine a pop-up window opens and announces, "Incoming from Alex—50 credits!" And then after the credit-up takes place, a second pop-up appears on Charlie's screen, saying "Thanks, Dude!" Upon Charlie's touching of the second pop-up within 3 seconds, the message "Incoming from Charlie—Thanks, Dude!" appears on Alex's screen for a period of 3 seconds, and then disappears.

In this manner, the recipient receives a message to understand the award amount and who it came from, and may acknowledge the donor, said acknowledgement message displaying on the donor machine. It is envisioned that in this manner, camaraderie shall develop between the various players playing at a bank of gaming machines.

The invention may apply to pays during the base game or a bonus game. For example, a special symbol, e.g. a Heart, may always give an extra payoff with 1 or more other players. So, 3 Hearts on a pay line may pay 100× line bet on the initiating machine, but also pay 25× line bet to another random player. In the case of a single player on the bank or group of gaming machines, the extra award may be given back to the lone player.

In a preferred embodiment, the local controller monitors, via time-stamp, each gaming machine's most recent wager on the base game, whether there is a game in progress, and if not, the time elapsed since the game over result of the prior game. This information is utilized to determine which players are active, hence eligible to be given extra awards. It is done to prevent a player from sitting at a machine, idle, hoping to "vulture" extra awards from the other players that are wagering. In a preferred embodiment, eligible machines are those in which, at the time of a particular player getting an extra award, the machine is active, that is either being played (game over has not yet occurred, e.g., reels spinning, a bonus game in progress, etc.) or within a prescribed time, preferably 5 seconds, of a game over.

EXAMPLE 4

Exchange of Attributes

In a preferred embodiment, players, either before or during a community bonus game, may exchange features or attributes. It is to be understood that as used herein, attributes affect game play, and preferably, the expected value of a bonus game. So for example, in a game where players' characters are attempting to slay a dragon, a stronger metal sword (capable of destroying the dragon in 3 hits, or awarding 50× line bet for each hit) and a weaker spear (capable of destroying the dragon in 5 hits, or awarding only 30× line bet for each hit) are attributes that a character may have. Alternatively, a bonus may comprise a set of free spins of fixed reel strips, wherein the number of spins and the bonus multiplier are attributes of the bonus. In this case a multiplier attribute of 3× may have the effect of increasing the expected value of the free spin bonus by three times that if the multiplier attribute were only 1×. Similarly, 7 free spins are worth 40% more than 5 free spins, for example.

Consider the example of a bonus game wherein players are represented by characters comprising medieval warriors attempting to defeat a series of monsters. In a preferred embodiment, players collect attributes (e.g., shoes, boots, leather suit, chain-mail suit, armor suit, sword, club, spear, bow, arrows, helmet) during the base game (e.g., through symbol alignment) or in-machine bonus games before launching a community bonus game.

Consistent with the intent being to achieve a common objective, the common goal is to defeat a series of monsters, where after, the players may each partake in the plunder by choosing a series of awards hidden inside treasure chests. Note that the players work together to achieve a common goal (defeating the monsters) as perhaps only a part of the game play. Other portions of game play may still have the players pitted against each other. For example, once the monsters are defeated, the players may each have a set time limit to open as many treasure chests as possible, keeping the bounty found therein. On-screen, chests opened by one player will also appear as opened on the other player's screen, etc.

So as to maximize their chances of defeating the monsters, the players may trade amongst themselves for the possessions.

Consider characters who ideally have three kinds of protection (head, body, feet) and one type of weapon, and the case in which 4 players have collected the following possessions (e.g., in the base game, or a preliminary bonus game).

Player 1: shoes, leather suit, club, bow
Player 2: boots, armor suit, chain-mail suit, helmet, sword
Player 3: chain-mail suit, spear, helmet, helmet
Player 4: boots, armor suit, arrows In the trading feature described herein, the 4 players would be able to engage in commerce (buy, sell, barter, trade) amongst themselves. So for example, Player 3 has an extra helmet and may decide to sell the helmet to Player 1 for a specific number of credits. This would put Player 1 in a position of having one of each kind of protection (head, body, feet) and a weapon. Player 3, however, would still be short of feet protection. Player 1 has a club but also has a bow that cannot be used without arrows. As Player 4 has arrows but no bow, then Player 4 may buy the bow from Player 1. Player 2 has two kinds of protective suit but may only wear one, so Player 2 may sell one of the suits to a player that doesn't have a suit (in this case every player has a suit). However, he may still sell a suit of better quality to a player who currently has a weaker suit. In this case, for example, Player 2 may sell the chain-mail suit to Player 1, to improve the attributes of Player 1's character. In principle, Player 2 may, for a high enough price, sell the better armor suit, and keep the inferior chain-mail suit for him.

In another embodiment, players would first decide what they wanted to sell (and buy, in one embodiment) in a "want ad" type of format. So Player 1 might decide to sell the bow. Player 2 might decide to sell the arrows and chain-mail suit. Player 3 might decide to sell a helmet. Player 4 may not sell anything. A screen then appears in front of each player showing what is available to buy. Asking prices may accompany each item for sale, or a set price per item type may be utilized. In another embodiment, the items are auctioned off quickly. In another embodiment, a player may make an offer on an item of interest, which is then accepted/rejected by the seller.

In a preferred embodiment, the local controller would automatically inventory each player's possessions, and without hurting any player, help players in need of specific possessions if any such extra attributes exist. A player "donating" any such possessions may be given a bonus award. So in the situation described earlier, the controller would donate the chain-mail suit from Player 2 to Player 1, a helmet from Player 3 randomly to either Player 1 or Player 4, and the bow from Player 1 to Player 4. In this way, each player is neutral or benefits by such exchanges, and the individual players are generally stronger after the exchanges. The exchanges may take place immediately prior to the community bonus game, at the initiation of the bonus game, or otherwise.

For example, in a preferred embodiment, if a first player already had the best body protection (say, the armor suit) and, during the course of wagering upon the base game collects a chain-mail suit (randomly or by player choice), then the local controller would immediately automatically take the chain-mail suit away from the first player and give it to a second, needy player who either has no suit or a suit inferior to chain-mail (e.g., leather). Preferably, this exchange is done at no charge to the second player, while the donating player receives a credit-award. In this manner, the players are helping each other (and themselves) in a spirit of camaraderie. As with the extra award discussion earlier, the players preferably are informed as in the case of Peggy on machine #2 giving chain-mail to Peter on machine #3: On machine #2 "You donated chain-mail to Peter—25 credits!" On machine #3 "Courtesy of Peggy—A gift of chain-mail!" and in response, back on machine #2 "Thank you from Peter!".

The local controller is able to accomplish this transfer of attributes preferably through a state-change transmission of information, an example of which has been described earlier. In this case, the local controller preferably keeps an inventory of each machine's current attributes. When alerted by a machine that an extra, unneeded attribute has been collected (e.g., the chain-mail suit by the first player at machine #1), the controller determines which machine the attribute should go to (e.g., machine #2 which has no body protection) and moves the attribute to the appropriate machine. At the same time, the local controller instructs machine #1 to give an award to the player for donating said item. In the case of multiple machines desiring an item, the local controller may randomly choose the recipient, or may apply an algorithm in which the "neediest" player (that is, the player with the least favorable current attributes, or the player who would be helped the most in receiving the extra attribute) receives the item.

In this manner, a player playing an individual base game or in-machine feature or bonus, may help other players gain attributes that may be utilized in the community bonus game. That is, a player, based on in-machine results at the individual machine, may help players playing at other individual machines, such that when all players participate in the community bonus game, the expected value and/or game play is affected.

EXAMPLE 5

Exchange of Information, Attributes

In a preferred embodiment, players, during an in-machine bonus game, may exchange game-related information with other players.

Consider the case in which a first player is playing a trivia-based bonus game in-machine, in which a correct answer yields a bigger award than an incorrect answer, and doesn't know the answer to a question. He may query the other players by sending out a "What's your guess?" type of message that includes the pertinent trivia question. The other players may then answer the question, to the best of their ability. The local controller totals the responses and presents the "poll results" to the first player in real-time, preferably.

This format has the advantage in that the first player, when stumped with an answer, may query the other players for an instant "poll" or "ask the audience" type of feedback. This may cost the first player a modest amount (e.g., 1/10 of the potential award) or may be free. The stumped player thus gains information about what the other players think is the correct answer, prior to having to answer the question. Preferably, the ability to "poll" may be a feature or attribute that is accumulated, or otherwise obtained, during play of the base game or a bonus game, and optionally exercised by a player. Also preferably, players who respond to the poll and answer correctly are given an award for doing so, should the first player also answer the question correctly. Alternatively, players who respond to the poll correctly are given an award for answering correctly, whether or not the first player answers correctly.

As another example, consider the case in which a first player is offered a first trivia-based question, preferably in the form of a pop-up box, which he/she doesn't like. The player may decide to pass on the question, leaving it for another player to answer. In a preferred embodiment, the player "flicks," with a sweeping touch motion, the question off the screen. The local controller then randomly selects another gaming machine for the question to land upon, and the pop-up enters that screen so that a second player may answer the question. In turn, this second player may flick the question off, in which case the controller transfers the question to a third player, etc. In this way, a series of questions, in rapid-fire format, may be presented to each of the players in a frenzied trivia-based bonus round. Each of the players, in turn, may answer some questions and pass other questions on to the other players, in the hopes that someone else will be able to answer them correctly.

This format may be utilized to have players working together. For example, a community bonus award may be based upon how many questions can be answered correctly by all players in a set amount of time. Or the award may be a function of how many net (right minus wrong) questions are answered correctly by all players in a set amount of time.

Trivia Game Example

Consider a bank of 10 gaming machines arranged as 5 gaming machines back-to-back with 5 others. Each side of gaming machines comprises a "team". Once the community bonus game initiates, each machine is presented with a trivia question. Once everyone has responded, the total number of correct answers for each team is shown. In a preferred embodiment, after a predetermined amount of time (e.g., 10 seconds), a random answer is chosen for any non-responding player.

Every correct answer gives the individual player an award, and in addition, each member of the team that has the most correct answers gets a bonus award. In case of a tie, the team to complete the answers first wins, or alternatively a tiebreak proximity question may be given. Several rounds may be played in this fashion, with the team winning the most rounds being declared the overall winner and given an additional bonus award. In this manner, an individual player may obtain awards for getting individual trivia questions correct, an additional award for being on the team that wins a trivia round, and yet an additional award for being on the team that wins the overall community bonus game.

In the case of unequal team membership (for example, 3 players against 4 players), then the local controller first modifies the game to comprise 4 questions (the greater of the number of players on each team). From the team with fewer players, the local controller randomly selects 1 of the 3-member team to receive 2 questions, such that 4 questions are answered by each team each round.

In a preferred embodiment, at the beginning of each round 3 possible questions are presented to each player, and the players then choose the questions their opponents will have to answer for the round. This adds an element of uncertainty and additional suspense to the game, as players try to outwit their opponents.

Trivia Game Example

Consider a bank with 6 active gaming machines. In total six trivia questions will be presented to the 6 players. Randomly, a first gaming machine receives a first trivia question. The first player may answer the question, or pass it along to another random gaming machine. Ultimately, the first player must answer one, and only one, question, and the same will be true for each of the other players. An additional bonus or bonus award is given if all questions are answered correctly.

In a variation of the preceding, the first player may be presented six trivia categories, perhaps with award values also presented. The player selects a category and receives his/her question. The five remaining categories are then presented to the next random player, and so forth. The final player does not get to select a category but must answer the final question in the final category. An additional bonus award, or bonus game, is given if all questions are answered correctly.

Survey-Based (Family Feud) Example

Consider a bank of 6 gaming machines arranged as 3 gaming machines back-to-back with 3 others. Alternately, the 6 machines are oriented adjacent to each other, with the leftmost 3 machines a different color than the rightmost 3 machines. In any event, two "teams" of machines are utilized. A community bonus round may be played, under the teachings herein, in the following manner.

Upon initiation, an overhead display announces the start of the community bonus game. Preferably, all active gaming machines receive an initial entry award into the community bonus. The local controller selects one player from each "team" (denoted as Team A and Team B herein) to participate in the first phase of the game. Simultaneously, the same question, e.g. "Name an exciting job" is displayed to both of these players, together with 10 possible answers. Five of the answers are correct answers, as obtained from a survey. For purposes of explanation, assume the correct answers are, in order, 1) Police officer, 2) Firefighter, 3) Soldier, 4) Pilot, 5) Athlete; the incorrect answers are 1) Flight attendant, 2) Movie star, 3) President, 4) Casino dealer, 5) Bounty hunter. The 10 possible answers are randomly ordered on-screen, with the same random ordering on both players' screens.

Among the two players, the first answer touched is accepted, so it is a race to provide an answer. If the player to first answer is correct, then control is passed to that team of players (say, Team A). Preferably, all members of Team A are given an award. Otherwise, control is passed to the other team, with an associated award for each team member. For the team in control (say, Team A), the players take turns selecting answers until either 3 answers are wrong or all correct answers are selected. Preferably, each correct answer yields an award for each member of Team A, and each wrong answer gives an award to each member of Team B. If all answers are selected then Team A wins, and preferably each member of Team A wins a bonus award. However, if Team A gets 3 wrong answers, then control transfers to the Team B for one final guess from a Team B player. If this player's guess is correct then Team B wins, and preferably each member of Team B wins a bonus award; otherwise, Team A wins.

In one embodiment, the two initial players are chosen randomly, but in another embodiment the two initial players are the players on each team with the highest wager. Similarly, in one embodiment, after 3 wrong answers, the final guess is randomly given to a player on the opposing team, but in one embodiment the final guess goes to the player with the highest wager.

In each of these trivia-based community bonus games, the game play may incorporate attributes that players exchange with each other. For example, a player may be able to give a teammate a "Eliminate One Wrong Answer" attribute, by consulting a menu of attributes collected on the player's screen, selecting the "Eliminate One Wrong Answer" attribute, and donating it, e.g. by "flicking" it, to the player currently answering the question. One of the wrong answers is thereby eliminated on the player's screen, enhancing the player's chance of getting the correct answer. Similarly, a teammate may donate a "50/50" attribute that eliminates a sufficient number of wrong answers, such that only the correct answer and one wrong answer remain. Other attributes usable in this way include a "Stop the Clock" attribute that suspends the timer counting down and a "Show Correct Answer" that informs the player of the correct answer.

These and other attributes may be, in principle, utilized by a player for an in-machine bonus, utilized by a player for a community bonus, donated to another player for the other player's in-machine bonus, or donated to another player during a community bonus. In this way, camaraderie among team members is accentuated.

EXAMPLE 6

Competition

In a preferred embodiment, players, during a community bonus game, may each in turn make attempts at completing the goal.

Consider the case in which a community bonus game comprises a set of 100 objects. Behind 99 objects are hidden numeric awards (e.g., 100× line bet, 200× line bet, etc.) and behind one object is hidden a top award such as a progressive award.

A player triggering the community bonus is awarded a number of picks equal to the line bet (e.g., the player is prescribed 3 picks for a line bet of 3 credits). The player wins the sum of the awards picked. So, a first player with 3 picks would have a 3/100 chance of finding the progressive. If the progressive is not won by the first player, then the game position (preferably, at least the objects and associated awards already picked) is saved by the local controller such that a future player may also play in the same community bonus, with previous picks (from other players) depicted.

A few spins later, on a different machine in the same community link, a second player wagering 5 credits per line triggers the community bonus. The second player thus has a 5/97 chance of winning the progressive. This is because the player receives 5 picks and is the beneficiary of having only 97 objects remaining, when the second player plays the community bonus game. The second player has benefited from the information revealed by the first player. If the progressive is not won by the second player, then again the game position is saved for future players.

For example, some spins later, a third player wagering 3 credits per line triggers the community bonus. The third player thus has a 3/92 chance of winning the progressive. This is because the player receives 3 picks and is the beneficiary of having only 92 objects remaining. The third player is the beneficiary of information revealed by both the first and second players. If the progressive is not won by the third player, then again the game position is saved for future players, and so forth.

It can be seen from this embodiment that the game, as described herein, has several advantages. First, if former players do not win the progressive, then subsequent player have increased odds of winning the progressive. Second, as the number of objects remaining decreases, subsequent players are incentivized to wager more in order to, if triggering the community bonus, maximize their chance of succeeding in winning the progressive award. Too, as the number of objects decreases, suspense grows with each slot play and with each visit to the bonus game, to see if the progressive is won.

Finally, the progressive award continues to grow as players miss picking the object hiding the progressive award.

It should be noted that in one preferred embodiment, the community bonus game of this embodiment is such that a player, upon triggering the bonus, takes the prescribed number of picks, at which point the community bonus game ends and the position is saved. In this way, the community bonus is placed in hiatus until a next player triggers it, and continues play where the prior player left off. Also in this preferred embodiment, a player who wins the progressive immediately causes a new set of 100 objects with hidden values to initiate, and, if a second player triggers the bonus while the first player is still picking, then the second player is caused to wait until the first player has completed the bonus.

In another preferred embodiment, a first player triggering the community bonus potentially initiates the bonus for all players to take turns in succession. The first player takes a first turn, taking a prescribed number of picks based on the first player's wager. Thereafter, the other players, randomly or in a predefined order, take their turns, each for a prescribed number of picks (based on that player's individual wager). This may continue until each player has had a turn, at which point the bonus is over. Alternately, it may continue until the progressive is won, in which case each player may receive multiple turns, until a player finds the object that awards the progressive. Alternately, it may continue until either the progressive is won or each player has had a turn, whichever comes first. In a most preferred embodiment, if the progressive is not won then the prevailing game state is saved, so that a subsequent group of players playing the bonus game is the beneficiary of values already revealed, enhancing their probability of winning the progressive award.

Variations include the use of multiple progressive awards that may be discovered. In one preferred embodiment, finding the top award awards the lesser progressives also. In one preferred embodiment, finding the top award awards all the remaining unpicked awards. In one embodiment, the top award is a progressive funded, for example, by a percentage of wagers on all linked machines eligible for the community bonus. In another embodiment, the top award is a fixed award, for example 1,000,000 credits.

In a preferred embodiment the local controller stores the prevailing game position in memory, and transmits the information to a qualifying gaming machine when needed. The gaming machine in turn transmits the prevailing game position back to the local controller after a player's pick or turn. In an alternate embodiment the local controller is not utilized, and the machines instead communicate with each other via a bus.

In a most preferred embodiment, the game state saved by the local controller includes the location of objects picked (e.g., 2nd row, 4th column), the picked objects themselves (e.g., blue seashell), and associated awards already picked (e.g., 50× line bet), and an array of remaining unpicked awards. At such time as the bonus game will be played at one of the linked machines, the controller generates a set of unpicked objects and randomly assigns remaining hidden awards, thereby randomizing the remaining unpicked awards amongst the remaining unpicked objects. In this manner, an added layer of security is present. However, in another embodiment, the controller simply keeps track of each object, its award, and whether or not it has been picked, with no randomization of unpicked awards between visits to the bonus game.

While this embodiment has been described in terms of a picking game of a set of objects, other embodiments are possible. For example, the goal may be to pick a combination that opens a safe. The correct combination is selected in advance of the first play by the local controller. The combination may comprise three numbers each 1 through 5, selectable by the player of the community bonus game. For example, 3-2-4 is one possible combination. In total there are 125 (equal to 5×5×5) such combinations. The correct combination wins the progressive, and an incorrect combination wins a lesser prize. Of course, with each combination selected that is incorrect, future players are beneficiaries as fewer possible combinations remain (since players are not allowed to reselect previous non-winning combinations). Once the correct combination is selected, the game cycle repeats.

In a preferred embodiment, the depiction of all of the objects is displayed to the player participating in the community bonus game on the player's gaming machine display, and the player preferably makes selections via touch-screen on the individual gaming machine. During game play, the depiction of all of the objects is also displayed on an overhead display, so that other players and passers-by may view the community bonus game play and vicariously participate in the suspense.

Of course, the various features of the invention may be implemented in various manners. The above described examples merely comprise examples of implementations of the features and concepts of the invention. In one embodiment, for example, the various features may be presented or implemented via community main games or events.

The various features and concepts of the invention have numerous advantages. One advantage is that additional exciting games or events may be presented by using existing gaming machines. This allows casinos to update existing expensive technology to make it more exciting and enticing to players. In addition, the various features of the invention make gaming activity more exciting to players. One advantage of the invention is that the community bonus event makes base wagering game play more exciting as players of the base gaming events anticipate the triggering of a community bonus event. In addition, the sharing, competition and cooperation features of the invention foster interaction and camaraderie between and among the players. This fosters greater interest in game participation, and thus longer term game play by players.

What is claimed is:

1. A method of playing a community bonus event, by a plurality of players who wager on a plurality of linked electronic gaming devices, said bonus event comprised of a plurality of attributes which affect an expected value of community bonus awards awarded to each player as a result of said bonus event, said method comprising:

triggering the community bonus event;

transferring an attribute of said plurality attributes from a first player to a second player through said link;

establishing an outcome of the community bonus event for the first player and the second player;

evaluating the outcome of said community bonus event relative to said first player based upon said first player no longer having said transferred attribute;

evaluating the outcome of said community bonus event relative to said second player based upon said second player acquiring said transferred attribute;

awarding a first community bonus award to said first player for said community bonus event based upon the outcome and said first player no longer having said transferred attribute; and awarding a second community bonus award to said second player for said community bonus event based upon the outcome and the second player acquiring said transferred attribute;

wherein said expected value of the first community bonus award and the second community bonus award is improved as a result of the transfer of said attribute, compared to without said transfer of said attribute.

2. The method of claim 1 wherein said transferring of said attribute is initiated by said first player.

3. The method of claim 1 wherein said transferring of said attribute is initiated automatically without input from said first player or said second player.

4. The method of claim 1 wherein said gaming devices are linked by a local controller and said attribute is transferred via said local controller.

5. The method of claim 1 wherein said gaming devices each include a main display and a top box having a secondary game presentation device and said community bonus event comprises an event presented via said top box of said gaming devices.

6. The method of claim 1 wherein said community bonus event comprises a bonus event wherein said players cooperate to achieve the outcome.

7. The method of claim 1 wherein said community bonus event comprises a bonus event wherein said players compete against one another.

8. The method of claim 1 wherein said attribute comprises an object used in said community bonus event.

9. The method in accordance with claim 1 wherein said attribute comprises an icon.

10. The method of claim 1 wherein said attribute was collected by said first player during a portion of a game played outside of said community bonus event.

11. The method of claim 10 wherein said game played outside of said community bonus event comprises at least one base game.

12. The method of claim 1 wherein said attribute is transferred from said first player to said second player based upon purchase of the attribute by said second player from said first player.

13. The method of claim 1 wherein said attribute is transferred from said first player to said second player based upon a trade by said second player, and further comprising the step of transferring a second attribute of the plurality of attributes from said second player to said first player.

14. A method of playing a community bonus event, by a plurality of players who wager on a plurality of linked electronic gaming devices, said community bonus event comprised of a plurality of attributes which affect an expected value of community bonus awards awarded to each player as a result of said bonus event, said method comprising:

triggering the community bonus event via at least one processor;

transferring, via the at least one processor, an attribute of said plurality of attributes from a first player to a second player through said link;

continuing said community bonus event relative to said first player based upon said first player having a set of attributes that does not include said transferred attribute;

continuing said community bonus event relative to said second player based upon said second player having a set of attributes which includes said transferred attribute;

establishing, via the at least one processor, an outcome of the community bonus event for said first player and said second player;

awarding a first community bonus award to said first player for said community bonus event based on an evaluation of the outcome of the community bonus event based on the set of attributes of said first player not including said transferred attribute; and awarding a second community bonus award to said second player for said community bonus event based on an evaluation of the outcome of the community bonus event based on the set of attributes of said second player including said transferred attribute;

wherein said expected value of the first community bonus award and the second community bonus award is improved as a result of the transfer of said attribute, compared to without said transfer of said attribute.

15. The method of claim 14 wherein said transferring of said attribute is initiated by said first player.

16. The method of claim 14 wherein said transferring of said attribute is initiated automatically without input from said first player or said second player.

17. The method of claim 14 wherein said gaming devices are linked by a local controller and said attribute is transferred via said local controller.

18. The method of claim 14 wherein said gaming devices each include a main display and a top box having a secondary game presentation device and said community bonus event comprises an event presented via said top box of said gaming devices.

19. The method of claim 14 wherein said community bonus event comprises a bonus event wherein said players cooperate to achieve an outcome.

20. The method of claim 14 wherein said community bonus event comprises a bonus event wherein said players compete against one another.

21. The method of claim 14 wherein said attribute comprises an object used in said community bonus event.

22. The method of claim 14 wherein said attribute comprises an icon.

23. The method of claim 14 wherein said attribute was collected by said first player during a portion of a game played outside of said community bonus event.

24. The method of claim 23 wherein said game played outside of said community bonus comprises at least one base game.

25. The method of claim 14 wherein said attribute is transferred from said first player to said second player based upon purchase of the attribute by said second player from said first player.

26. The method of claim 14 wherein said attribute is transferred from said first player to said second player based upon a trade by said second player, and further comprising the step of transferring a second attribute of the plurality of attributes from said second player to said first player.

* * * * *